US008534463B2

(12) United States Patent
Smith

(10) Patent No.: US 8,534,463 B2
(45) Date of Patent: Sep. 17, 2013

(54) ELECTRONIC DEVICE ACCESSORY SYSTEM

(76) Inventor: Wiley Smith, Sapulpa, OK (US)

( * ) Notice: Subject to any disclaimer, the term of this patent is extended or adjusted under 35 U.S.C. 154(b) by 104 days.

(21) Appl. No.: 12/868,879

(22) Filed: Aug. 26, 2010

(65) Prior Publication Data

US 2012/0048848 A1 Mar. 1, 2012

(51) Int. Cl.
*B65D 85/86* (2006.01)
*B65D 73/00* (2006.01)

(52) U.S. Cl.
USPC ..... 206/775; 206/471; 206/461

(58) Field of Classification Search
USPC ..... 206/461, 779, 471, 462, 463, 470, 206/815, 806, 763, 776, 775, 320, 702; 220/4.02, 23.87, 23.89
See application file for complete search history.

(56) References Cited

U.S. PATENT DOCUMENTS 3,297,289 A 1/1967 Raus
3,392,823 A 7/1968 Green et al.
4,165,805 A 8/1979 Fethke et al.
4,179,029 A 12/1979 Fethke et al.
4,423,811 A 1/1984 Knapp
4,431,717 A 2/1984 Kikuchi
4,546,879 A * 10/1985 Viscasillas ..... 206/391
4,637,516 A 1/1987 de Roure
4,702,374 A 10/1987 Kelner
4,719,698 A 1/1988 Ninomiya et al.
4,739,353 A * 4/1988 Heuer et al. ..... 206/316.2
4,872,551 A 10/1989 Theros
4,892,220 A * 1/1990 Foos ..... 220/835
4,899,877 A 2/1990 Kiernan
4,925,025 A 5/1990 Anten et al.
5,048,677 A 9/1991 Pedracine
5,064,056 A * 11/1991 Gresh ..... 206/321
5,129,516 A * 7/1992 Theros ..... 206/463
5,172,806 A 12/1992 Mickelberg
5,279,417 A 1/1994 Seaton
5,289,916 A * 3/1994 Mickelberg ..... 206/756
5,348,145 A 9/1994 Steinfels, III
5,398,809 A * 3/1995 Henke et al. ..... 206/373
5,407,066 A * 4/1995 Grange ..... 206/228
5,411,138 A 5/1995 Klawiter
5,435,447 A 7/1995 Weatherford et al.
5,595,295 A 1/1997 Lin
5,622,258 A 4/1997 Baublitz et al.
5,636,741 A 6/1997 OKeefe
5,803,253 A 9/1998 Zakarian
5,816,401 A 10/1998 Vasudeva et al.
5,871,099 A 2/1999 Mellenthin
5,890,594 A * 4/1999 Hansen et al. ..... 206/472
6,126,008 A 10/2000 Cox
6,216,866 B1 * 4/2001 Schoenberg ..... 206/320
6,241,092 B1 6/2001 Vasudeva (Continued)

*Primary Examiner* — Steven A. Reynolds
(74) *Attorney, Agent, or Firm* — Connie R. Masters

(57) ABSTRACT

An electronic device packaging system that allows customer access, through a side accessible opening, to a connector of an enclosed electronic device is disclosed. The electronic device packaging system includes a front member and a back member that cooperate to form a device-accommodating compartment to enclose the electronic device. The device-accommodating compartment has at least one side configured with the side accessible opening through which the electronic connector is graspable by the customer through the accessible opening disposed on the side of the front member. The side placement of the "try it" feature allows full utilization of the front and back of the package for advertising graphics or information, or product display, thus resulting in a compact, efficient package, with advantages for both retailers and customers.

12 Claims, 7 Drawing Sheets

(56) References Cited

U.S. PATENT DOCUMENTS

| | | | | |
|---|---|---|---|---|
| 6,265,332 | B1 | 7/2001 | Yoshida et al. | |
| 6,311,839 | B1 | 11/2001 | Lo | |
| 6,349,830 | B1 | 2/2002 | Le Bron | |
| 6,364,115 | B1 * | 4/2002 | Casanova et al. | 206/471 |
| 6,401,932 | B1 * | 6/2002 | Weinstein et al. | 206/779 |
| 6,422,389 | B1 * | 7/2002 | Ritola et al. | 206/486 |
| 6,467,617 | B1 | 10/2002 | Chen | |
| 6,727,826 | B1 | 4/2004 | Ki Kwan et al. | |
| D504,811 | S | 5/2005 | Haingaertner | |
| 6,899,222 | B2 | 5/2005 | Jones et al. | |
| 6,953,117 | B2 | 10/2005 | Schein et al. | |
| 6,968,950 | B2 | 11/2005 | Eisenbraun | |
| 6,993,803 | B2 | 2/2006 | Chan et al. | |
| 7,293,651 | B2 * | 11/2007 | Lee et al. | 206/463 |
| 7,389,876 | B2 * | 6/2008 | Hong et al. | 206/581 |
| D609,560 | S * | 2/2010 | Mchatet | D9/415 |
| 2001/0032799 | A1 * | 10/2001 | Shinada | 206/576 |
| 2002/0153278 | A1 * | 10/2002 | Pirro et al. | 206/704 |
| 2002/0162771 | A1 | 11/2002 | Van Wagenen et al. | |
| 2003/0052033 | A1 | 3/2003 | Schwester | |
| 2003/0205500 | A1 | 11/2003 | Schein et al. | |
| 2004/0079668 | A1 * | 4/2004 | Lee | 206/471 |
| 2004/0149615 | A1 | 8/2004 | Eisenbraun | |
| 2004/0222118 | A1 | 11/2004 | Melgaard | |
| 2005/0172492 | A1 | 8/2005 | Blaustein et al. | |
| 2005/0284788 | A1 | 12/2005 | Elliott et al. | |
| 2006/0011505 | A1 | 1/2006 | Chen | |
| 2007/0014626 | A1 * | 1/2007 | Claussen | 401/258 |
| 2007/0056872 | A1 | 3/2007 | Begim | |
| 2007/0170087 | A1 * | 7/2007 | Narpes et al. | 206/703 |
| 2008/0289297 | A1 | 11/2008 | Tsang | |
| 2009/0114565 | A1 | 5/2009 | Dhuru | |
| 2012/0031809 | A1 * | 2/2012 | Methe et al. | 206/703 |

* cited by examiner

ELECTRONIC DEVICE ACCESSORY SYSTEM

FIELD OF THE INVENTION

The present invention relates generally to product packaging for consumer products, and more particularly, to an improved packaging system and method for packaging an electronic device for merchandising display in which a customer may gain access to a portion of the device, such as a desired connector, to assure suitability of use.

DESCRIPTION OF THE PRIOR ART

Portable consumer electronic devices are ubiquitous in modern life. Most customers own numerous devices of various types; each of these devices may need to be connected to one or more other electronic devices (including electronic device accessories), such as a power supply, charger, headset, earphone, cable, external monitor, speakers, or the like. (Throughout this disclosure, the term "electronic device" is intended to mean both electronic devices typically used on a standalone basis, and electronic device accessories typically used in connection with an electronic device.) However, electronic device manufacturers currently do not provide device connectors in a single, standard connector type. Instead, each device is configured with a particular type of device connector that will only fit and operate with the complementary type of dedicated connector. This lack of uniformity, wherein each accessory or other electronic device (having a dedicated connector) can only operate with one type and brand of electronic device, causes numerous disadvantages for customers and retailers.

To meet the needs of customers, retailers must stock each device or accessory with a variety of types of dedicated connectors. Customer frustration may occur when attempting to locate the electronic device having the proper dedicated connector that will mate with his or her device connector among the displayed rows of packaged electronic devices with diverse, assorted types of connectors. Confusion is increased by the small size of the connectors of the packaged electronic devices and their lack of distinguishing features. If the connectors are sealed within the electronic device packaging, customers must read a list of model numbers (often confusingly similar and printed in small type). These difficulties frequently result in damaged packaging, unwanted purchases, and returns of opened packages. Also, time and attention may be required from store personnel to assist customers in finding the right connectors and in accepting and dealing with returns.

Thus, an electronic device connector that can be accessed by customers and checked by them for compatibility with their electronic devices before purchase is highly advantageous for both retailers and customers. An advantageous design allows access to the connector through an opening in the packaging, herein denoted as a "try it" feature, yet retains the electronic device and most of the cord within the packaging. Customers can physically attempt to mate the dedicated electronic connector on the exterior of the packaging with their electronic devices, without breaking the seal of the merchandise, without damaging the packaging, and without purchasing the electronic device.

Various types of "try it" packaging have been disclosed, yet each fails to adequately meet the needs of the customer and the retailer. For example, a "try it" packaging for an electronic device is described by Eisenbraun in U.S. Pat. No. 6,968,950 as providing a front wall recess with an aperture in the blister package allowing the connector to be disposed in the front recess, exterior of the closed volume that packages the remainder of the electrical device. The front "try it" feature suffers from several problems, as embodied in the typical hanging display package. If the customer does not replace the cord and connector neatly within the front access opening, the messy result will obscure a portion of the front package information, lead to an unappealing display, and require additional employee time to straighten the display. Also, the row of packages may no longer hang compactly. For example, if the cord and connector are not restored correctly within the front recess of a rearwardly positioned hanging package, the forward packages will be displaced by the partially removed cord and connector and the row will be in disarray. Further, the already small area available on the front face of the small package is reduced by the access opening and recess; thus the prime front advertising and informational space is reduced and the packaging is rendered less appealing.

An Interactive Product Packaging is presented by Dhuru et al. in U. S. Published Application No. 2009/0114564. A portion of a lock is accessible through a window (having at least one large circular portion) in the front of the package. This package and lock combination allows the customer to operate the lock by rotating a thumbturn exposed through the circular front window. Optionally, it also allows the customer to open the top of the packaging box to retrieve a reset key that can be inserted into a key slot exposed in the large circular front accessible window, so the deadbolt assembly can be rekeyed without removing the lock from the packaging. This packaging has a relatively large front access window, so also suffers from the above mentioned reduction in prime front advertising and informational space. Though the size and configuration of the circular front window may be suitable for exposing the circular portion of a sturdy lock that does not have loose members, the packaging presented does not lend itself to the retention of the connector and attached cord of a packaged electronic device. Thus, if such a packaging system is used to package an electronic device, shelf discipline would be reduced, usage of employee time would be increased, and damage to delicate electronic connectors and cords would be increased.

Another "try it" or interactive-type packaging is presented in U.S. Patent Publication 2004/0222118 by Melgaard. This packaging is only suitable for a product with a transverse handle extending from the body of the product, such as a hot glue gun. The body of the product and a tip of the handle are enclosed within the packaging, with a portion of the handle exposed so that a user can grip the handle of the product and engage the trigger while still in the packaging.

Another interactive packaging is the Clamshell Package with Spinner Insert by Begim presented in U.S. Patent Publication 2007/0056872. In this packaging system the customer interacts with the package, not with the product. The product is housed in a sealed compartment within the spinner. The spinner can be manually rotated within the outer clamshell package, but the customer is not allowed access to any portion of the product. Though the Begim package system may draw attention to the product on display, it is not adapted to allow the customer to determine suitability of fit of an electronic device connector, as the product is completely sealed within the spinner.

Similarly, U.S. Published Application No. 2006/0011505 by Chen presents a Sealed Packing Box with a Size Checking Space that allows the customer to interact with the packaging. The product is completely sealed within an intact compartment in the packaging. In another location of the packaging, the material of the packaging is contoured to provide a size-checking space that allows the customer to insert an article, such as a cell phone or nut, to determine if the article will generally fit within the packaged product, such as a cell phone case or wrench. Thus, the size-checking space is economically constructed and contoured from the packaging material, but the precision of fit is necessarily limited, though the rough estimate of the fit may be sufficient for the purposes presented. As connectors of electronic devices are quite small and must fit with sufficient precision to allow transmission of data and/or energy, a contour provided in packaging material does not have sufficient distinctness and accuracy to assure a correct fit. The customer interacts with the molded packaging and cannot access any part of the actual product.

Two interactive packages for a toy wheeled vehicle product are presented in U.S. Patent Publication No. 2005/0284788 by Elliot et al. and in U.S. Patent Publication No. 2008/0289297 by Tsang. Both have generally planar cardboard backing boards that are intact (without an interactive opening) and have an attached blister-pack-type cover defining a cavity for holding the toy. In the Tsang packaging a switch extends through the front of the package, with a conductor operative to conduct electricity between the switch and toy to cause the toy to move. In the Elliot packaging system the front blister-pack-type cover has a space between a center hub and a center front cover portion, allowing (through the front of the packaging) manual urging of movement of the toy within the packaging. Thus, neither toy packaging is suitable for allowing a customer to try the connector of a packaged electronic device while the packaged electronic device is sealed within the spinner. Moreover, both reduce valuable front display space.

Accordingly, there is an established need for an efficient packaging system that provides a readily accessible opening for allowing a customer to attain the electronic device connector for determining suitability of fit, yet leaves the front and the back of the packaging available for valuable advertising, informational and display space. In this way, advantages accrue to both customers (easily and quickly finding the correct electronic device) and retailers (reducing package size and shelf space required for display, preserving shelf order, reducing returns, and reducing usage of employee time for such work as tidying the display, handling returns, and providing assistance in determining the correct connector).

SUMMARY OF THE INVENTION

The present invention is directed to an electronic device packaging system that allows customer access to a connector of an enclosed electronic device through an accessible opening disposed on the side of the packaging system. The electronic device packaging system includes a front member that coordinates with a back member to form a clamshell-type outer enclosure to enclose the electronic device within a device-accommodating compartment. The device-accommodating compartment is sized and configured to contain the packaged electronic device. An optional inner securing member may secure at least a portion of the electronic device within the device-accommodating compartment. The electronic device connector is preferably restrained by an external side-wall restraint niche, reachable through the accessible opening disposed on the side of the device-accommodating compartment. The side accessible opening provides advantages for both customers and retailers.

An object of the present invention is to provide an electronic device packaging system that allows full utilization of the valuable product display, advertising and informational space of the front and back of the package, while providing a convenient "try it" feature.

An additional object of the present invention is to provide an electronic device packaging system that can be adapted to package a wide variety of electronic devices.

A further object of the present invention is to provide an electronic device packaging system that allows a customer to gain access to a portion of the packaged electronic device, such as a desired connector, to assure suitability of use.

Another object of the present invention is to provide an electronic device packaging system that provides advantages to retailers, such as a more compact package, a reduction in shelf display space, an increase in shelf tidiness, a reduction in labor, or a reduction in returned items.

These and other objects, features, and advantages of the present invention will become more readily apparent from the attached drawings and from the detailed description of the preferred embodiments, which follow.

BRIEF DESCRIPTION OF THE DRAWINGS

The preferred embodiments of the invention will hereinafter be described in conjunction with the appended drawings, provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

Shown throughout the figures, the present invention is directed toward an efficient electronic device packaging system with at least one side accessible opening. The side accessible opening allows a customer to gain access to a portion of the packaged electronic device (such as a desired connector or other fitting) to assure suitability of use, i.e., a "try it" feature. The side of the package is not typically used for the display of the product or of informational material, such as advertising graphics or product details, thus the placement of the accessible opening on the side maximizes the availability of the front and back of the package for such informational material and product display. Consequently, the side placement allows the electronic device to be packaged in a smaller, more compact package, advantageously reducing shelf space required for display.

Using the unexploited side of the packaging for the accessible opening provides advantages for customers and retailers. For retailers, the electronic device packaging system provides excellent product visibility, product shelf appeal, product security and product presentation, while reducing the packaging size, decreasing required shelf space, maximizing the space available on the package front and package back for graphics and product display, reducing the quantity and cost of manufacturing materials, preserving shelf order, lessening product returns, and decreasing employee time usage (such as for tidying the display, handling returns, and providing assistance in determining the correct connector). For customers, the placement of the accessible opening on the package side expedites the selection of the appropriate electronic device. The increase in usable space on the package front and/or package back (while still providing a "try it" feature) allows more useful information and graphics to be presented; thus the shopping experience of customers is enhanced through both the increase of available information space and the provision of the "try it" feature allowing them to attempt to mate the connector with their electronic device.

The electronic device packaging system of the present invention is particularly adapted for packaging of any of a wide variety of electronic devices having a dedicated electronic connector that connects to a customer's particular device electronic connector. Such packaged electronic devices include, for example, a power supply, DC or AC charger, headset, earphone, or other small customer electronic items having a cord with a distal connector, socket, or other fitting (such as, for example, cables having a connector on at least one end or small electronic devices having a connector disposed on a cord or cable).

Figure 6:
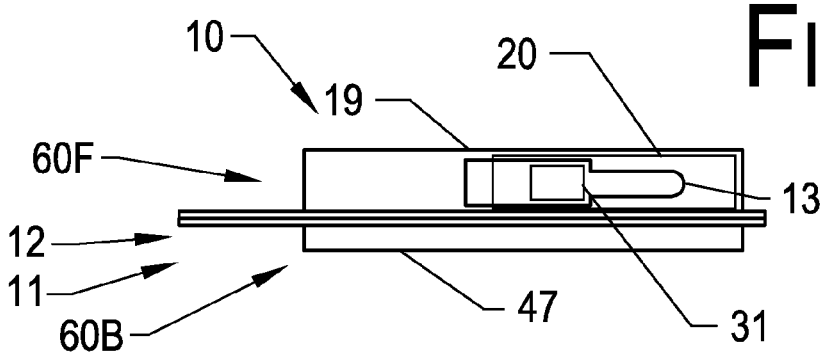
FIG. 6 is a side view of a second embodiment of the electronic device packaging system of the present invention.
Figure 7:
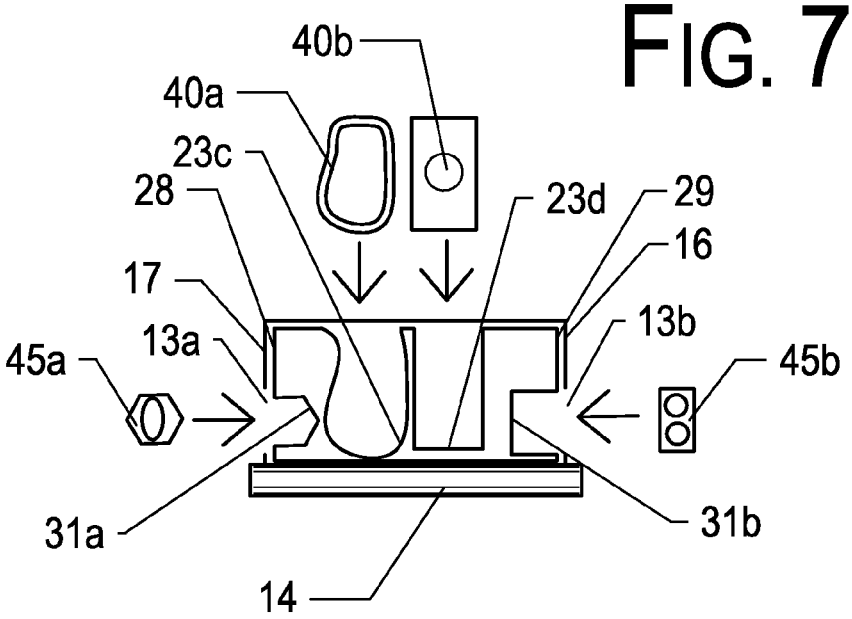
FIG. 7 is a cut view from the end of a third embodiment of the electronic device packaging system of the present invention, illustrating multiple side accessible openings allowing access to multiple electronic device connectors.
Figure 9:
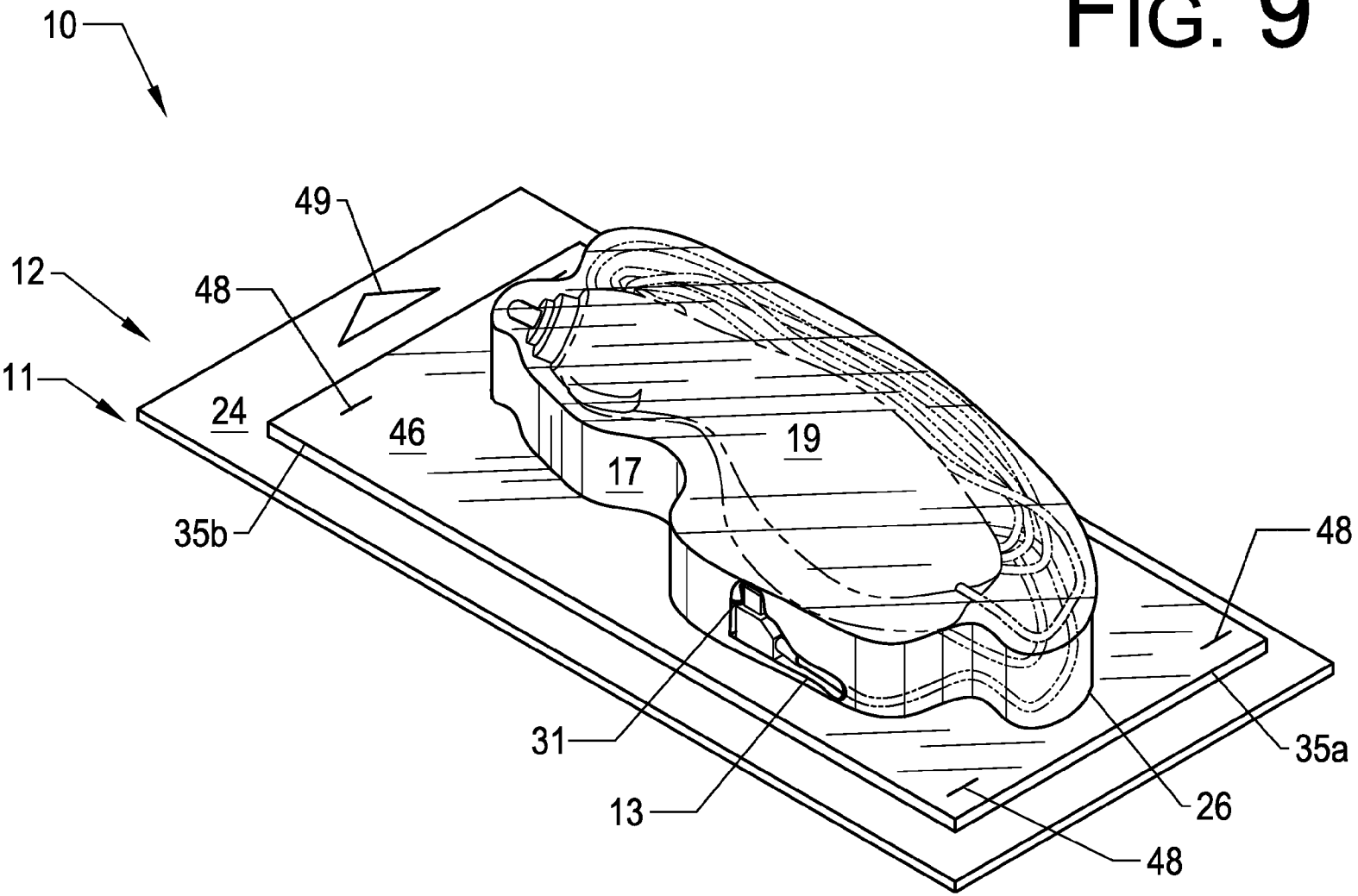
FIG. 9 is a perspective view showing a fourth embodiment of the electronic device packaging system of the present invention.

Four embodiments of the electronic device packaging system, shown generally as reference number 10, are presented, all with at least one side accessible opening 13, all with a main portion of an electronic device enclosed within the packaging system and a secondary portion of the electronic device accessible to a user via the side accessible opening 13, and all with the front and back walls free of accessible openings for maximum front and back display space for the product and informational material. The first embodiment of FIG. 1 to FIG. 5 illustrates the side accessible opening 13 of the present invention incorporated into a typical clamshell-type outer enclosure with an inner securing member 20. The second embodiment of FIG. 6 illustrates a second type of clamshell-type outer enclosure with the side accessible opening 13 of the present invention. The third embodiment of FIG. 7 illustrates the packaging of two electronic devices within the electronic device packaging system with side accessible openings 13 on two side walls. The fourth embodiment of FIG. 9 illustrates the side accessible opening 13 of the present invention as utilized with a third type of clamshell-type outer enclosure having sides contoured to correspond to the enclosed electronic device 40 and without the optional inner securing member 20.

All four embodiments comprise a front member 12 and a back member 11 that cooperate to form a device-accommodating compartment 60 that is adapted to receive the electronic device 40. The front member 12 is configured to be engageable with a back member 11, and when engaged, forms an inner void or cavity within the device-accommodating compartment 60. The device-accommodating compartment 60 includes a front wall 19 (FIG. 3), back wall 47 (FIG. 6),and a plurality of side walls. Though herein illustrated with the device-accommodating compartment 60 generally rectangular with four side walls, it may optionally be formed in other geometric shapes, such as triangular, hexagonal, etc. as desired to suit the enclosed electronic device. The device-accommodating compartment 60 has at least one side configured with a side accessible opening 13. When the main portion of the electronic device 40 is enclosed within the device-accommodating compartment 60 of the electronic device packaging system 10, a secondary portion, such as connector 45 (preferably held within a recessed restraint niche 31) is manually accessible or graspable through the side accessible opening 13. The specific size, shape, and positioning of the side accessible opening 13 may vary based on functional and aesthetic considerations. (The directions "front," "back," "upper," and "lower," as used herein, refer to the directions when the packaging system is hanging from hanging apparatus 49.)

Figure 1A:
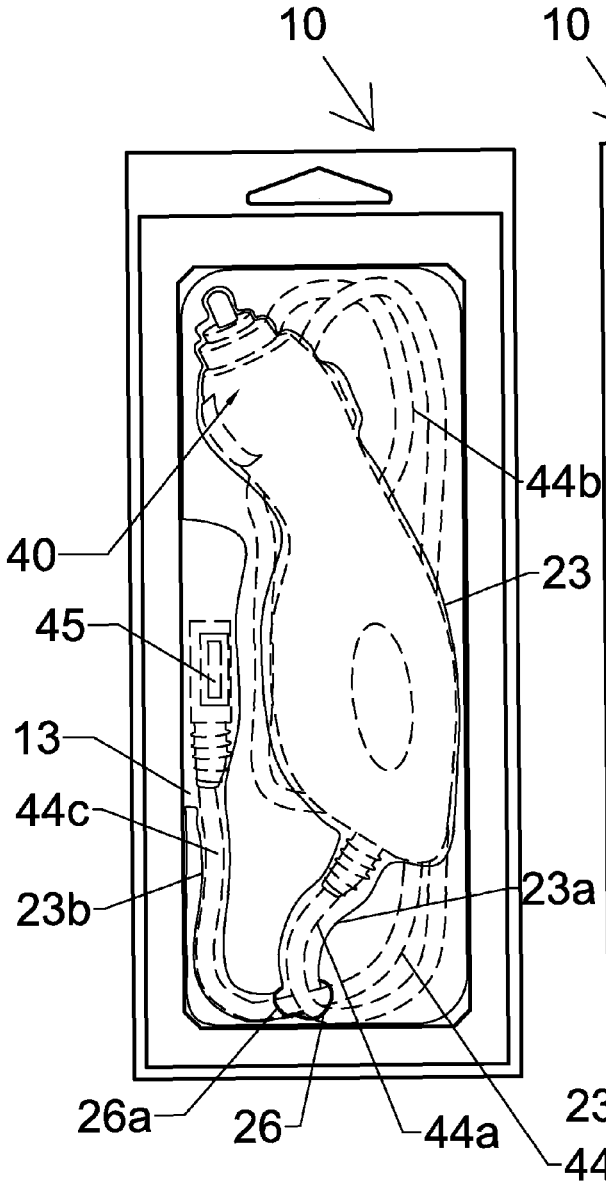
FIG. 1A is a front view showing a first preferred embodiment of the electronic device packaging system of the present invention with the packaged electronic device displayed within the packaging system.

Referring now to FIG. 1A to FIG. 5, the electronic device packaging system, is illustrated in accordance with a first embodiment of the present invention. FIG. 1A shows the compact, space-efficient design of the electronic device packaging system 10, minimizing shelf space required for retail display.

Figure 1B:
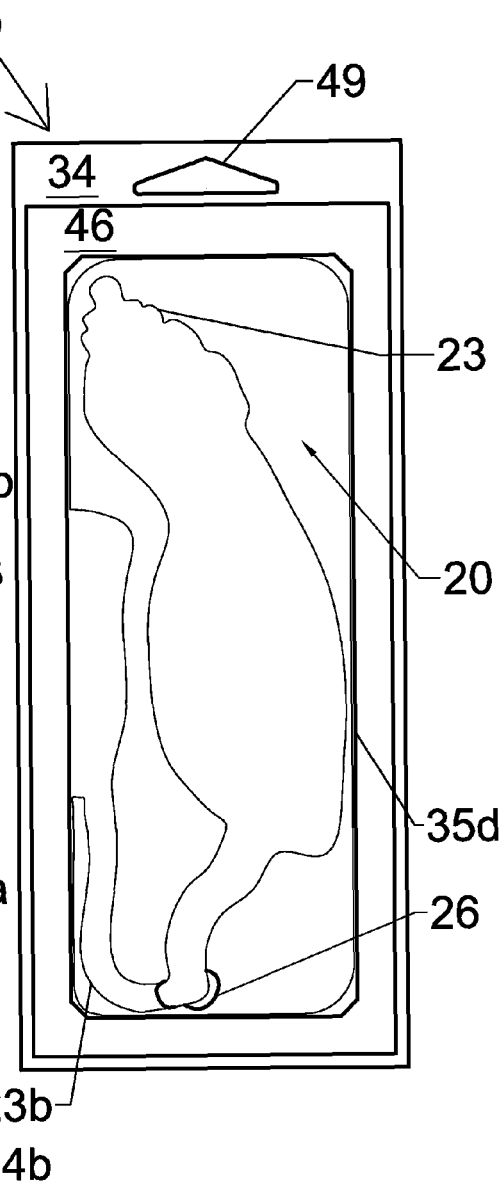
FIG. 1B is a front view showing a first preferred embodiment of the electronic device packaging system of the present invention without the electronic device displayed in the packaging system.
Figure 3:
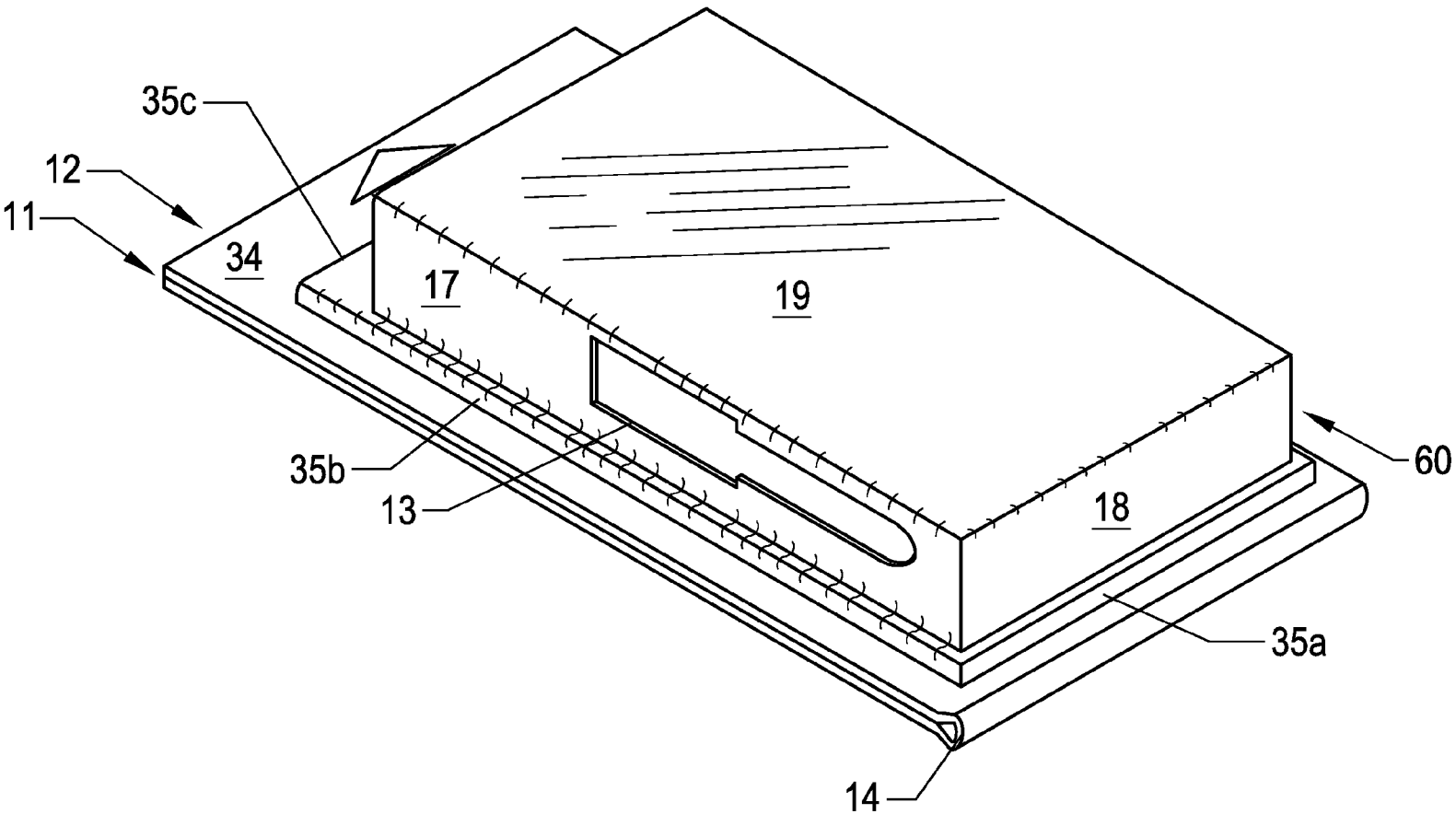
FIG. 3 is a perspective view showing a first preferred embodiment of the electronic device packaging system of the present invention without an inner securing member.
Figure 4:
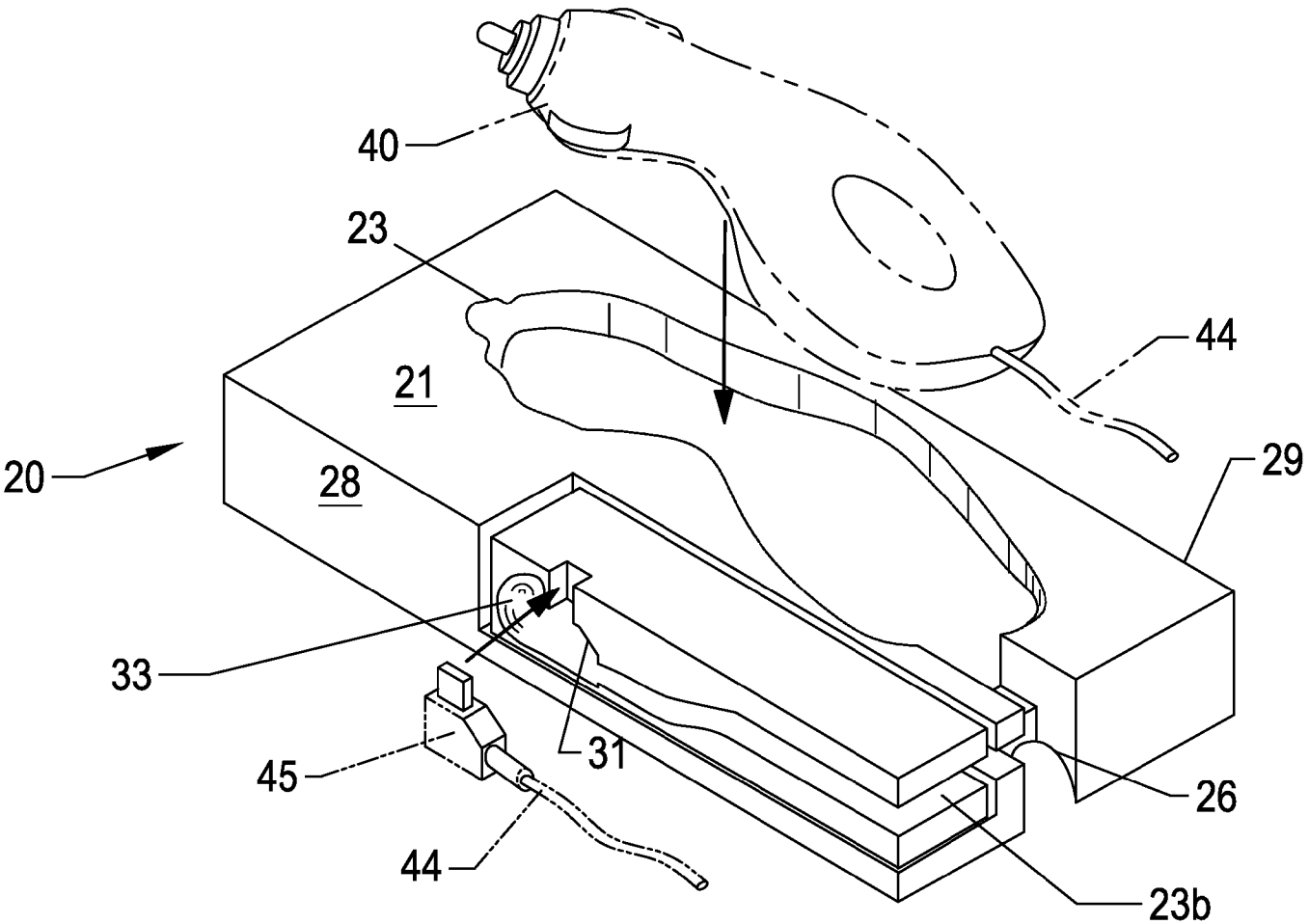
FIG. 4 is a perspective view showing an inner securing member configured to fit within the clamshell-type outer enclosure of FIG. 3 of a first preferred embodiment of the electronic device packaging system of the present invention.

As shown, the electronic device packaging system 10 of the first embodiment includes a clamshell-type outer enclosure with at least one side accessible opening 13 (FIG. 2) and includes an optional inner securing member 20 (FIG. 1B, FIG. 4). The clamshell-type outer enclosure comprises front member 12 (FIG. 2, FIG. 8) engageable with back member 11 to form device-accommodating compartment 60 (FIG. 3) for receiving the electronic device 40, which is secured by the inner securing member 20.

Figure 2:
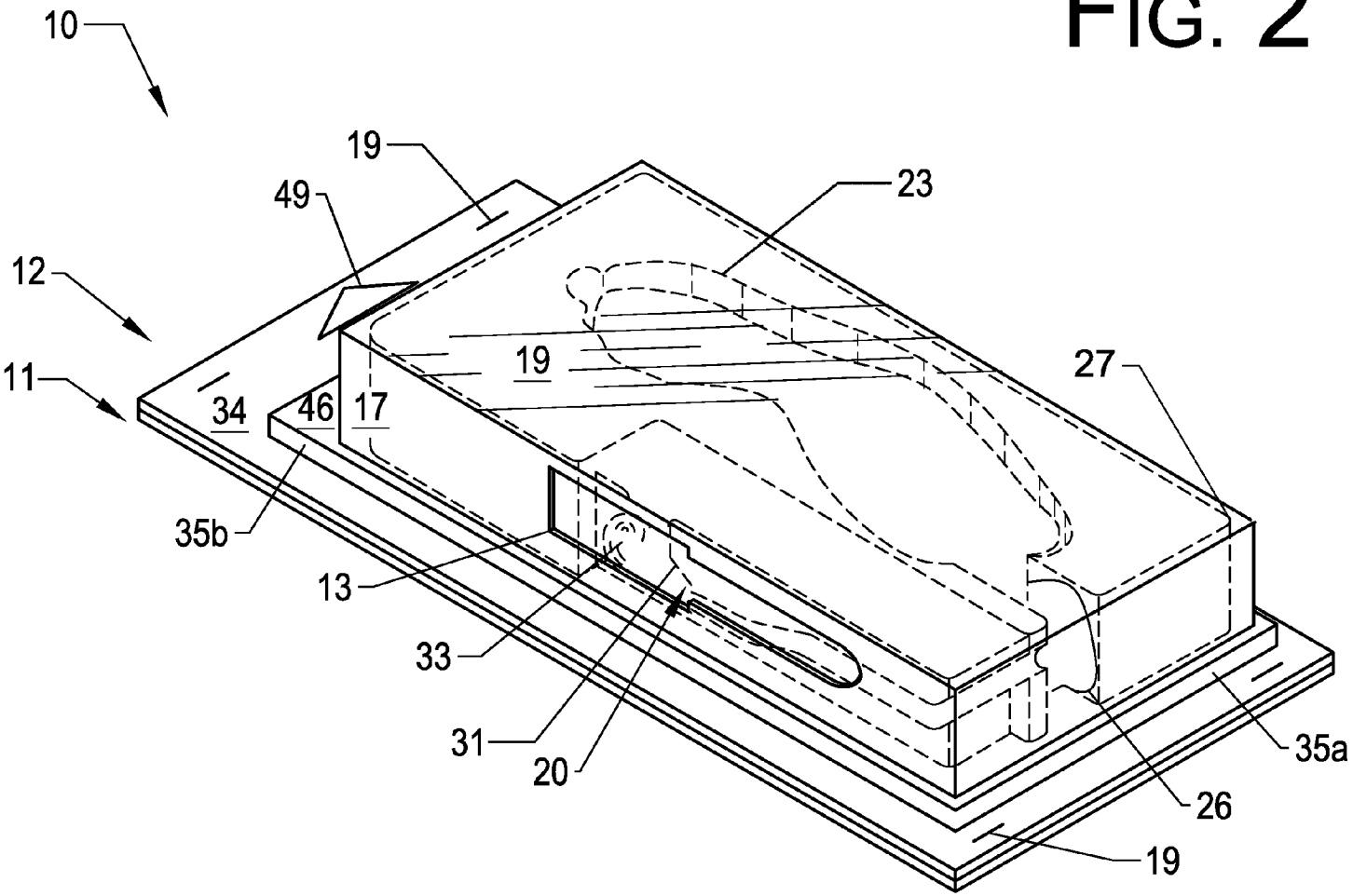
FIG. 2 is a perspective view showing a first preferred embodiment of the electronic device packaging system of the present invention.

In FIG. 2, the clamshell-type outer enclosure is shown with the optional inner securing member 20 inserted, and in FIG. 3, with the inner securing member 20 removed. The removed inner securing member 20 is shown in FIG. 4. The inner securing member 20 is configured to fit within the device-accommodating compartment 60 and is designed to aid in advantageously displaying the electronic device 40.

Inner securing member 20 is preferably designed with one or more particularly formed or molded device-receiving recesses 23, having a predetermined, generally concave, shape suitable for receiving at least a portion of the body and/or the cord of the electronic device 40. The device-receiving recesses 23 can be varied to conform to the outline of one or more portions of the electronic device 40. For example, the recesses 23 may include cord channel recesses (shown as device-receiving recess 23*a*, 23*b*, FIG. 1). The device-receiving recesses 23 can be configured to restrain or hold portions of the electronic device 40 tightly in one or more particular areas, or the concave device-receiving recesses 23 can be configured to allow the electronic device 40 to merely rest within the indentations 23 without restraint. The device-receiving recesses 23 also assist in providing an aesthetically pleasing display of the electronic device 40, while allowing customers to quickly identify the type of electronic device 40 within the electronic device packaging system 10.

The inner securing member 20 may be further configured with one or more cord conduits 26 providing a passageway from above to below the inner securing member 20. The one or more cord conduits 26 may be arranged to allow a portion of the cord 44 to run from above the inner securing member 20 to an underneath area (where the length of cord 44 may be stored in a less visible, more aesthetically pleasing position). In an exemplary routing of cord 44, as shown in FIG. 1A, the cord of the electronic device 40 may partially lie within a device-receiving recess 23*a* (cord portion 44*a*, FIG. 1A), may run through a cord conduit 26, may then run between the inner securing member 20 and the back member 11 (cord portion 44*b*), may pass through a second cord conduit 26*a* and run through a second device-receiving recess 23*b* (cord portion 44*c*).

The cord portion of the device-receiving recess 23*b* adjacent to the accessible opening 13 is preferably configured to allow a degree of movement of the cord 44, so as not to bind the connector 45 to such a degree that the customer cannot try the electronic connector 45. Yet, preferably, the cord portion of the device-receiving recess 23*b* is configured to provide a degree of restraint to prevent the customer from easily drawing a long length of cord 44 from the packaging system 10, which would be difficult to reinsert to recreate a tidy shelf display.

The particular design of the inner securing member 20 and its components, such as the device-receiving recesses 23 and cord conduit(s) 26, may be customized to the size and shape of the electronic device 40 and the size and length of the cord 44. For example, as the size, length, shape and type (coiled or uncoiled) of cord 44 may vary depending on the particular use and design of the electronic device, the size, shape and configuration of cord conduit(s) 26 and the device-receiving recesses 23 that hold portions of the cord 45 may vary to accommodate any cord 44.

As shown in FIG. 2, in the first embodiment a section of the inner securing member 20 is exposed through the accessible opening 13. This exposed inner-securing-member section is preferably configured with a particularly formed restraint niche 31 (FIG. 2, FIG. 4) having a pre-determined shape for receiving electronic connector 45 and for providing a degree of holding or confinement to the electronic connector 45. The pre-determined shape corresponds to at least a portion of the electronic connector 45, allowing a degree of frictional engagement of electronic connector 45 within restraint niche 31. The degree of engagement provided by the pre-determined shape allows the electronic connector 45 to be manually inserted, manually removed, and frictionally held within restraint niche 31.

The customer can easily disengage the electronic connector 45 from the restraint niche 31 to determine if a correct correspondence exists between the electronic device connector 45 and the customer's electronic device. The customer can also easily re-engage the electronic connector 45 within the restraint niche 31, thus preserving the orderly appearance of the electronic device packaging system 10. This side "try it" feature increases customer satisfaction, reduces merchandise returns, and increases salability of the electronic device, as the packaging does not need to be opened or destroyed to access the electronic connector 45. Further, if the customer does not reposition the electronic connector 45 correctly within the restraint niche 31, the side positioning of the "try it" feature (accessible opening 13 and restraint niche 31) allow the unrestrained connector 45 to extend laterally from the side of the package; the front of the packaging remains visible, and the rows of electronic device packaging still hang tightly, without the cord 44 and the connector 45 causing obstructions between adjacent packages.

The inner securing member 20 is also preferably configured with a formed finger depression 33 adjacent to restraint niche 31. The formed finger depression 33 is sized and configured to allow a customer to contact a recessed portion of electronic connector 45, thus facilitating removal of the electronic connector 45 from restraint niche 31.

In the first embodiment, the restraint niche 31 and formed finger depression 33 are disposed on side 28 (FIG. 4) of the inner securing member 20, and are positioned to be accessible through the accessibility opening 13 (FIG. 2, FIG. 3). Optionally, as shown in the third embodiment of FIG. 7, multiple restraint niches 31 (with or without one or more formed finger depressions 33) may be included to hold multiple electronic device connectors 45. Alternatively, the restraint niche 31 (as shown in the fourth embodiment of FIG. 9) and the formed finger depression 33 (not shown) may be disposed on a side section 17 of the device-accommodating compartment 60.

The inner securing member 20, though depicted for clarity as a separate component, may be formed in any of a variety of manners or combinations, while preserving the securing functionality. For example, the inner securing member 20 can be formed separately and remain unattached when inserted within the clamshell-type outer enclosure; the inner securing member can be formed separately and then be attached to one or more portions of the clamshell-type outer enclosure; the inner securing member 20 may be integrally formed with the clamshell-type outer enclosure; the inner securing member 20 may be formed integrally with the front member 12; the inner securing member 20 may be formed integrally with the back member 11; the inner securing member 20 may comprise multiple sections, with one or more sections formed integrally with the front member 12 and with one or more sections formed integrally with the back member 11; portions of the inner securing member 20 may be elevated and/or portions may be recessed, particularly to accommodate the device cord 44 or for functional or aesthetic reasons.

Figure 5:
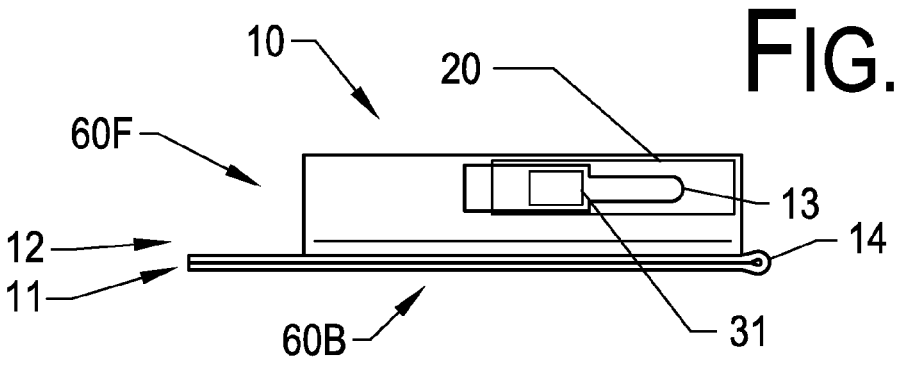
FIG. 5 is a side view of a first preferred embodiment of the electronic device packaging system of the present invention.

In the first embodiment, the front member 12 comprises the larger front portion 60F (FIG. 5) of the device-accommodating compartment 60, with the back member 11 comprising the remainder, generally planar, back portion 60B (FIG. 5).

The front portion 60F of device-accommodating compartment 60 protrudes forwardly a sufficient distance to accommodate the electronic device 40 and any inner securing member 20. Although the foregoing discloses a forwardly protruding expansion, and the balance of this disclosure refers primarily to embodiments where the device-accommodating compartment 60 is forwardly protruding, it may be understood that the invention disclosed herein is not limited to those embodiments, but may relate equally to embodiments where the compartment 60 protrudes backwardly from back member 11, such as in the case where it is preferred to display packaging graphics or copy on front member 12 (or on a blister card placed within or adhesively attached to front member 12) rather than display the electronic device 40. In such a case, it may be understood that all other functions as disclosed herein need only be varied to the small degree necessary to accommodate this "reverse" positioning of the expansion 60. In the same vein, this disclosure expressly encompasses embodiments where front member 12 and back member 11 cooperate to form the expansion 60 containing the electronic device 40, as shown in the second embodiment of FIG. 6.

Figure 8:
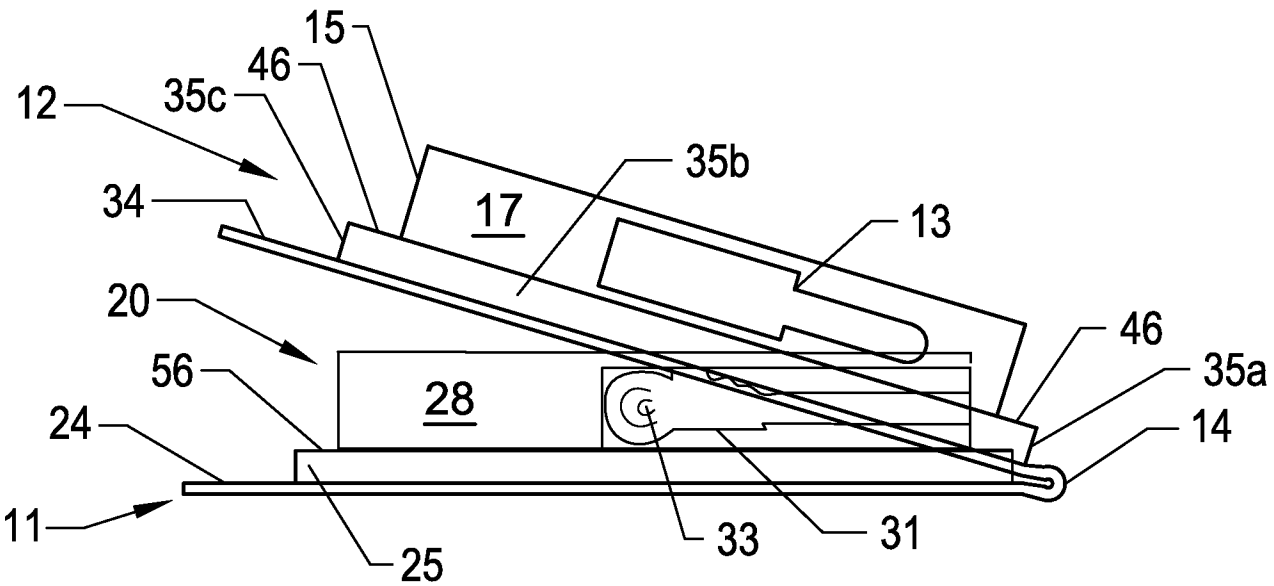
FIG. 8 is a side view showing the assembly of a preferred embodiment of the electronic device packaging system of the present invention.

The side walls in the first embodiment include a bottom wall 18, a first lateral wall 17, a second lateral wall 16 (FIG. 7), and a top wall 15 (FIG. 8). The first lateral wall 17, is configured with the side accessible opening 13, permitting access to the restraint niche 31 and the optional formed finger depression 33.

As shown in the third embodiment of FIG. 7, multiple side walls (shown as side wall 16 and side wall 17) may be configured with side accessible openings 13*a*, 13*b*. This configuration allows multiple electronic devices 40*a*, 40*b* (or a single electronic device 40 with multiple connectors 45*a*, 45*b*, not shown) to be packaged, displayed, and sold together. In this embodiment the multiple electronic devices 40*a*, 40*b* are supported within device-receiving recesses 23*c*, 23*d*, respectively, before front member 12 is positioned over back member 11. In this aspect of the invention, the electronic connectors 45*a*, 45*b* are held by restraint niches 31*a*, 31*b*, which are accessed through the side accessible openings 13*a*, 13*b*. To select a properly corresponding accessory or other device, the customer may remove one or both of the electronic connectors 45*a*, 45*b* from restraint niches 31*a*, 31*b* to attempt to mate the connectors 45*a*, 45*b* of the packaged device with the dedicated device connector of his or her portable electronic device.

Front wall 19 is preferably substantially transparent to allow viewing of at least a portion of the enclosed electronic device and of any inserted front label. Front wall 19 may be substantially planar and, thus, suitable for receiving a front label. The availability of the entire front wall 19, providing valuable advertising and informational space, allows use of any combination of one or more inserted front labels, adhered front labels, printing, and unobstructed viewing areas. Similarly, the back wall 47 (FIG. 6), is also free of accessible openings, so available for display of the product, informational materials or inserted labels.

The back member 11 is configured to engage with front member 12 utilizing any closure or folding mechanism as is known in the art. For example, as shown in FIG. 8, back member 11 may comprise a substantially planar rim border 24 extending inwardly from the perimeter. Front member 12 and back member 11 are configured with corresponding forward-protruding lips 25, 35, which are frictionally engageable to at least partially secure the clamshell-type outer enclosure. Extending inwardly from the perimeter of front member 12 is a substantially planar rim border 34 (FIG. 1B, FIG. 8); protruding forwardly from this front-member rim border 34 is front-member lip 35. Front-member lip 35 includes a lower front-member lip 35*a* (FIG. 2, FIG. 8), a first side front-member lip 35*b* (FIG. 2, FIG. 8), a top front-member lip 35*c* (FIG. 8), and a second side front-member lip 35*d* (FIG. 1B). A generally planar shelf 46 (FIG. 8) extends inwardly from the forward edge of lip 35 to intersect with the backward edge of the forward-protruding device-accommodating compartment 60. Back-member lip 25 (FIG. 8) protrudes forwardly from back-member rim border 24, having a size and shape corresponding to the front-member lip 35, thus allowing front-member lip 35 to be slidingly engaged over back-member lip 25 for closure of the clamshell-type outer enclosure. A back-member shelf 56 extends inwardly from the forward edge of back-member lip 25 forming a platform onto which the inner securing member 20 is positioned or may extend inwardly to intersect with the integrally formed inner securing member 20.

The front member 12 and the back member 11 of the clamshell-type outer enclosure may be formed as separate pieces (as shown in FIG. 2) or may be formed as a unit (as shown in FIG. 3) with an integral hinge 14 disposed between them. The front member 12 and the back member 11 may be sealed with temporary, semi-permanent or permanent devices and sealing methods, as are known or become known in the art. A temporary clamshell sealing method such as a snap lock or frictional seal may be used. A semi-permanent method such as stapling or riveting, as illustrated by the staples (clamshell fastener 48, FIG. 2) may optionally be used. Or, a permanent sealing mechanism or sealing technique, such as adhesives, spot sealing, UV sealing, ultrasonic sealing or radio frequency sealing may be utilized.

The clamshell-type outer enclosure is preferably configured with a hanging apparatus 49, such as an aperture, a tab, a hook, or other apparatus suitable for suspending the electronic device packaging system 10 from a hanging rack, peg or other projection in a retail store.

Though illustrated and described herein primarily with the back member 11 being generally planar to form the device-accommodating compartment back portion 60B (FIG. 5) and the compartment front portion 60F of front member 12 expanded to accommodate the device 40, other alternative constructions are within the scope of the invention. For example, the compartment front portion 60F may be generally planar and the back member 11 may comprise an expanded compartment back portion 60B to form a cavity to receive the electronic device as mentioned above (the reverse of FIG. 5). Alternatively, as illustrated in the second embodiment of FIG. 6 the front member 12 and back member 11 may cooperate more equally to form the cavity, e.g., the device-accommodating compartment front portion 60F may include a fraction of an expanded area with the device-accommodating compartment back portion 60B including the remaining fraction of the expanded area. Like the first embodiment, at least one of the four side walls (the upper, lower, left or right side wall) is configured with an accessible opening 13. Also, as in the first embodiment both the front wall 19 and the back wall 47 are unobstructed and free of accessible openings, therefore allowing maximum space for display of the product and informational materials, such as advertising, special offers, pricing data, packaging graphics, product details or the like.

The fourth embodiment of FIG. 9 illustrates the functionality of the side accessible opening 13 when integrated into a blister pack or clamshell-type packaging having contoured side walls generally conforming to the shape of the electronic device 40. The device-accommodating compartment 60 is contoured, as opposed to the more rectangular compartment 60 of the first three embodiments.

The fourth embodiment further illustrates the use of the electronic device packaging system 10 of the present invention without an inner securing member 20. Additionally, the restraint niche 31 of the fourth embodiment is formed within the compartment front portion 60F (as opposed to being formed as a part of the inner securing member 20, as in the first three embodiments).

The electronic device packaging system 10 of the present invention may be manufactured of any of a variety of materials, as are known or become known in the art, such as PVC (Polyvinyl Chloride), PET (Polyethylene Terephthalate), polypropylene or other plastic compounds. Preferably, the material chosen is substantially transparent to allow visual inspection of the enclosed device 40 and of any inserted front labels or other printed, descriptive material inserted within the electronic device packaging system 10; however, materials that are translucent or opaque are within the scope of the invention.

The variance in the size, shape, and design of the electronic device to be displayed and sold in the packaging system 10 may impose certain design constraints upon particular components of the electronic device packaging system 10. For example, one or more of the following customizations of the electronic device packaging system 10 may be desirable: customizing the shape, positioning and design of the side accessible opening 13 to fit the size and design of the connector; fashioning the device-accommodating compartment 60 in various shapes, such as a generally rectangular void (FIG. 3) or a contoured void (FIG. 9); constructing the components of the electronic device packaging system 10 with rounded or angular walls and edges; modifying the connector-restraint niche 31 due to the connector 45 design; designing the formed finger depression 33 to function with various connectors 45; adapting the inner securing member 20 to fit the device; forming the inner securing member 20 unitarily or of multiple sections; and/or customizing the clamshell-type outer enclosure for optimum display and utilization, such as by construction of the clamshell-type outer enclosure as a tri-fold package with a bottom section, thus providing flexibility to hang the product on a peg or to stand it on the shelf.

A retailer would typically receive multiple electronic devices 40, each contained within an electronic device packaging system 10 of the present invention. Each type of device 40 would then typically be placed in a row for display for convenience of perusal by the retail customer.

The retail customer can easily inspect the contents of the electronic device packaging system 10 and can choose a potentially satisfactory device 40. The customer can assure a suitable fit of the electronic connector 45 (usually after removing the electronic device packaging system 10 from the display) by inserting a finger tip into the formed finger depression 33 to draw out the electronic device connector 45 from the restraint niche 31. Then, the customer can attempt to mate the electronic connector 45 to the potentially corresponding connector on his or her electronic device. If the electronic connector 45 does not match the device connector, the customer can easily re-engage the electronic connector 45 into the restraint niche 31 before replacing the electronic device package 10 back on the display hook, thereby leaving the store display orderly.

From the foregoing, it will be apparent that the electronic device packaging system 10 of the current invention provides a smaller, more compact package that is adapted for use with a wide variety of electronic devices 40. The packaging system 10 provides advantages to retailers, such as a reduction in required shelf space, a reduction in labor, and a reduction in returned items. The trim, compact packaging system 10 provides advantages to manufacturers and distributors, such as a reduction in materials required for manufacture and a reduction in transportation costs. Further, the front wall 19 is unobstructed and free of an accessible opening, allowing a greater display area for marketing information or suitability details. The side customer-accessible "try it" feature also provides advantages to the customer, as the connection electronic connector 45 is easily accessible to determine suitability so the correct, complementary device 40 can be quickly purchased.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A packaging system for an electronic device having an electronic connector comprising:

a front member configured to form a portion of a device-accommodating compartment, wherein said front member comprises at least a front wall, wherein said device-accommodating compartment is adapted to receive said electronic device; and a back member adapted to cooperate with said front member to form said device-accommodating compartment, wherein:

said back member comprises at least a back wall;

said device-accommodating compartment comprises said front wall, said back wall, and a plurality of side walls;

at least one of said plurality of side walls is configured with a side accessible opening;

each of said plurality of side walls have a side wall area calculated by multiplying the length times the width of each of said plurality of side walls;

said front wall is free of a front accessible opening; wherein said front wall has a front wall area calculated by multiplying the length times the width of said front wall;

said front wall area is greater than any one of said side wall areas of said plurality of side walls;

said back wall has a back wall area calculated by multiplying the length times the width of said back wall;

said back wall area is greater than any one of said side wall areas of said plurality of side walls;

said back wall is parallel to said front wall over a majority of said back wall area;

said back wall is free of a back accessible opening;

said side accessible opening is configured to allow manual access to said electronic connector when said electronic device is enclosed within said device-accommodating compartment;

an inner securing member configured to secure at least a portion of said electronic device;

a section of said inner securing member is exposed through said side accessible opening; and said exposed inner securing member section is configured with a restraint niche adapted to restrain said electronic connector.

2. The packaging system as recited in claim 1, wherein said device-accommodating compartment is configured with a second side-accessible opening.

3. The packaging system as recited in claim 1, wherein:

said back member is substantially planar and forms said back wall of said device-accommodating compartment; and said front member is configured to form said plurality of side walls and to form said front wall of said device-accommodating compartment.

4. The packaging system as recited in claim 1, wherein:

said back member is configured to form the back and a portion of the sides of said device-accommodating compartment; and said front member is configured to form the front and a portion of the sides of said device-accommodating compartment.

5. The packaging system as recited in claim 1, wherein:

said back member is configured to form said back wall and said plurality of side walls of said device-accommodating compartment; and said front member is substantially planar and forms said front wall of said device-accommodating compartment.

6. The packaging system as recited in claim 1, wherein said exposed inner securing member section is further configured with a formed finger depression adapted to allow a customer to place a fingertip within said finger depression to aid in releasing said electronic connector from said restraint niche.

7. The packaging system as recited in claim 1, wherein said back member is formed unitarily with said front member.

8. The packaging system as recited in claim 1, wherein:

said back member is formed separately;

said front member is formed separately; and said back member is engageable with said front member.

9. The packaging system as recited in claim 1, wherein said back member is sealed to said front member.

10. The packaging system as recited in claim 1, wherein said device-accommodating compartment is further configured with one or more additional side accessible openings.

11. The packaging system as recited in claim 1, wherein said device-accommodating compartment is further adapted to receive one or more additional electronic devices.

12. A packaging system for an electronic device, comprising:

an inner securing member configured with at least one device-receiving recess for securing at least a portion of said electronic device, configured with a side-disposed restraint niche configured to restrain a connector of said electronic device, and configured with a formed finger depression disposed substantially adjacent to said restraint niche and adapted to allow a customer to contact said portion of said electronic connector secured within said at least one device-receiving recess;

a front member comprising at least a portion of a device-accommodating compartment configured to accommodate said inner securing member and said electronic device; wherein said device-accommodating compartment comprises at least one side wall configured with a[n] device-accessible opening adapted to allow access to a portion of said electronic device connector; and wherein said device-accessible opening is the only device-accessible opening of said packaging system; and a back member comprising at least a portion of said device-accommodating compartment; wherein said back member has a back width and a back length; wherein said front member has a front width and a front length; wherein said at least one side wall has a side width and a side length; wherein said back width and said back length are larger than or equal to said side width and said side length; wherein said front width and said front length are larger than or equal to said side width and said side length; and wherein said back member is engageable with said front-member to enclose said electronic device and said inner securing member.

* * * * *